United States Patent [19]

Hatta et al.

[11] 4,340,028

[45] Jul. 20, 1982

[54] OIL COMBUSTION TYPE INFRARED RAY GENERATING APPARATUS

[75] Inventors: Yoshio Hatta; Shigeo Suzuki, both of Fukuroi, Japan

[73] Assignee: Shizuoka Seiki Co., Ltd., Fukuroi, Japan

[21] Appl. No.: 148,867

[22] Filed: May 12, 1980

[30] Foreign Application Priority Data

May 11, 1979 [JP] Japan ..... 54-57831
May 11, 1979 [JP] Japan ..... 54-57832

[51] Int. Cl.[3] ..... F24C 3/04
[52] U.S. Cl. ..... 126/92 R; 431/329
[58] Field of Search ..... 126/92 R, 92 AC, 92 B, 126/92 C, 96, 259 R, 49, 209; 431/326, 329

[56] References Cited

U.S. PATENT DOCUMENTS

| | | | |
|---|---|---|---|
| 1,800,726 | 4/1931 | Grant | 431/326 |
| 2,670,032 | 2/1954 | Vignere | 431/326 |
| 2,994,520 | 8/1961 | Sherman | 126/92 B |
| 3,029,863 | 4/1962 | Downs | 431/326 |
| 3,229,680 | 1/1966 | Hebert et al. | 431/329 |
| 3,299,938 | 1/1967 | Bally et al. | 126/92 R |
| 3,326,265 | 6/1967 | Paulin | 126/92 R |
| 3,391,983 | 7/1968 | Harazono et al. | 431/329 |
| 3,488,137 | 1/1970 | Naganuma | 431/329 |
| 3,733,170 | 5/1973 | Kobayashi et al. | 431/329 |
| 3,734,677 | 5/1973 | Murase et al. | 431/329 |
| 3,762,390 | 10/1973 | Mendelson | 126/92 R |

*Primary Examiner*—Daniel J. O'Connor
*Attorney, Agent, or Firm*—Martin A. Farber

[57] ABSTRACT

An oil combustion type infrared ray generating apparatus comprising a red heat cylindrical body fitted to the top wall of a frustoconical furnace body which together with a pressure oil jet burner provided with a blower are mounted side by side on the flat surface of the fuel tank.

11 Claims, 10 Drawing Figures

FIG. 3
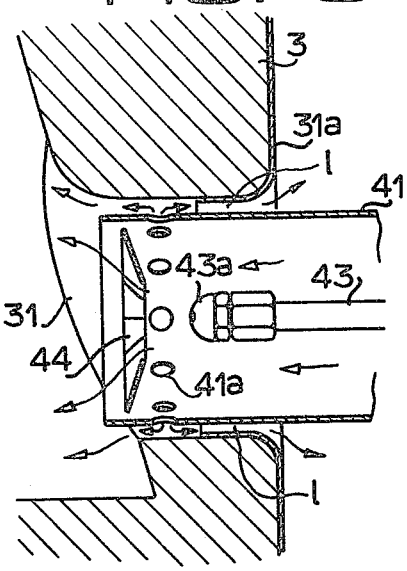
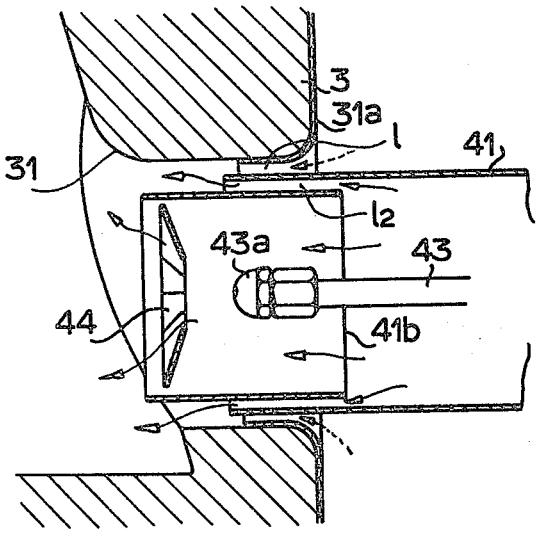
FIG. 4

OIL COMBUSTION TYPE INFRARED RAY GENERATING APPARATUS

BACKGROUND OF THE INVENTION

1. Field of the Invention

This invention relates to a portable oil combustion type infrared ray generating apparatus.

2. Description of the Prior Art

Such kind of infrared ray generating apparatus is operative to transfer heat by the radiation of heat and hence is suitable for use in heating rooms and drying painted surfaces at sites where the temperature of the surrounding air is frequently changed, for example, at indoor works where working vehicles such as a forklift, truck or the like or workmen are frequently going in and out or at outdoor working sites where civil works, constructional works or the like are carried out.

As infrared ray generating apparatus which can be used at the above mentioned sites without any trouble in a safe manner must satisfy the following conditions.

In the first place, the apparatus as a whole must be small in size and take up less space. Secondly the apparatus must provide a material increase in ability of generating infrared rays and be able to emit the infrared rays in a direction which is not limited to one plane. Third, the apparatus must be conveniently transportable and easy in handling. Finally, the apparatus must be less defective and easy in maintenance and inspection.

Heretofore it has been proposed to provide an oil combustion type infrared ray generating apparatus comprising a conical and cylindrical furnace body provided at its front side with an open large diameter portion and at its rear side with a reduced diameter portion, a pressure oil jet burner with a blower secured to the rear reduced diameter side of the furnace body, and a red heat disc body covering the front large diameter side of the furnace body and provided at its overall surface with a number of small holes.

Such kind of apparatus has the disadvantage that since the conical furnace body is provided at its front surface with the red heat disc body the furnace body becomes large in size by the dimension of the red heat disc body, and the apparatus as a whole is large in size, that the infrared rays are emitted in a direction inclusive of one plane only and that the apparatus takes up much space and operates to effect local heating or the like.

SUMMARY OF THE INVENTION

An object of the invention, therefore, is to provide an oil combustion type infrared ray generating apparatus which can eliminate the above mentioned drawbacks which have been encountered with the prior art techniques.

A feature of the invention is the provision of an oil combustion type infrared ray generating apparatus comprising a fuel tank composed of a vessel having a flat upper surface, a frustconical-shaped furnace body having an excellent heat insulating and refractory property and provided at its upper wall with an outlet opening, and at its side wall with an inlet opening, a pressure oil jet burner provided with a blower and connected to said inlet opening provided on the side wall of said furnace body, said furnace body and pressure oil jet burner with blower being mounted side by side on said flat surface of said fuel tank, and a red heat cylindrical body erected vertically from the upper part of said furnace body and formed of refractory material, said red heat cylindrical body being permeable to gas and connected to said outlet opening provided in the upper wall of said furnace body.

Further objects and features of this invention will be fully understood from the following detailed description with reference to the accompanying drawings, in which:

BRIEF DESCRIPTION OF THE DRAWINGS

FIG. 3 is an enlarged cross sectional view of another embodiment of an inlet opening portion of a furnace body shown in FIG. 2;

FIG. 4 is an enlarged cross sectional view of a further embodiment of an inlet opening portion of furnace body shown in FIG. 2;

DETAILED DESCRIPTION OF THE PREFERRED EMBODIMENTS

Figure 1:
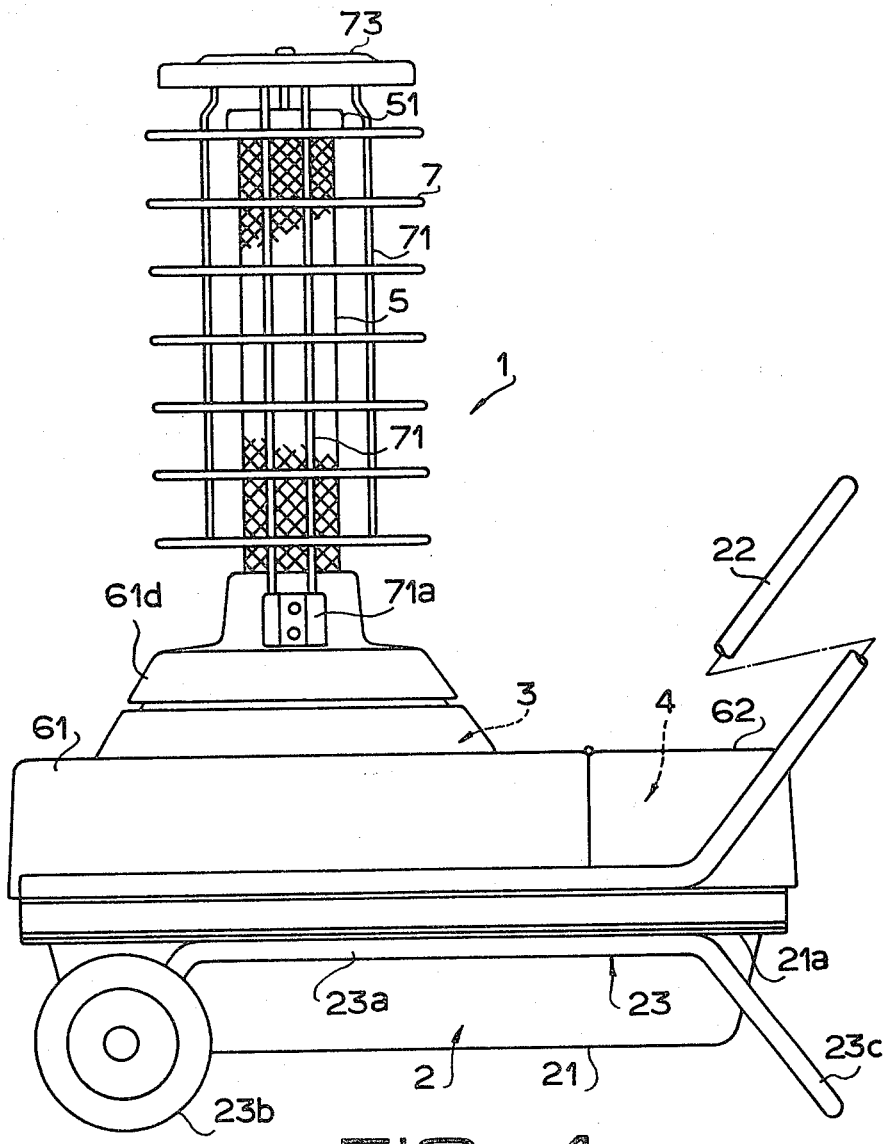
FIG. 1 is a side elevation view of one embodiment of an oil combustion type infrared ray generating apparatus according to the invention.
Figure 2:
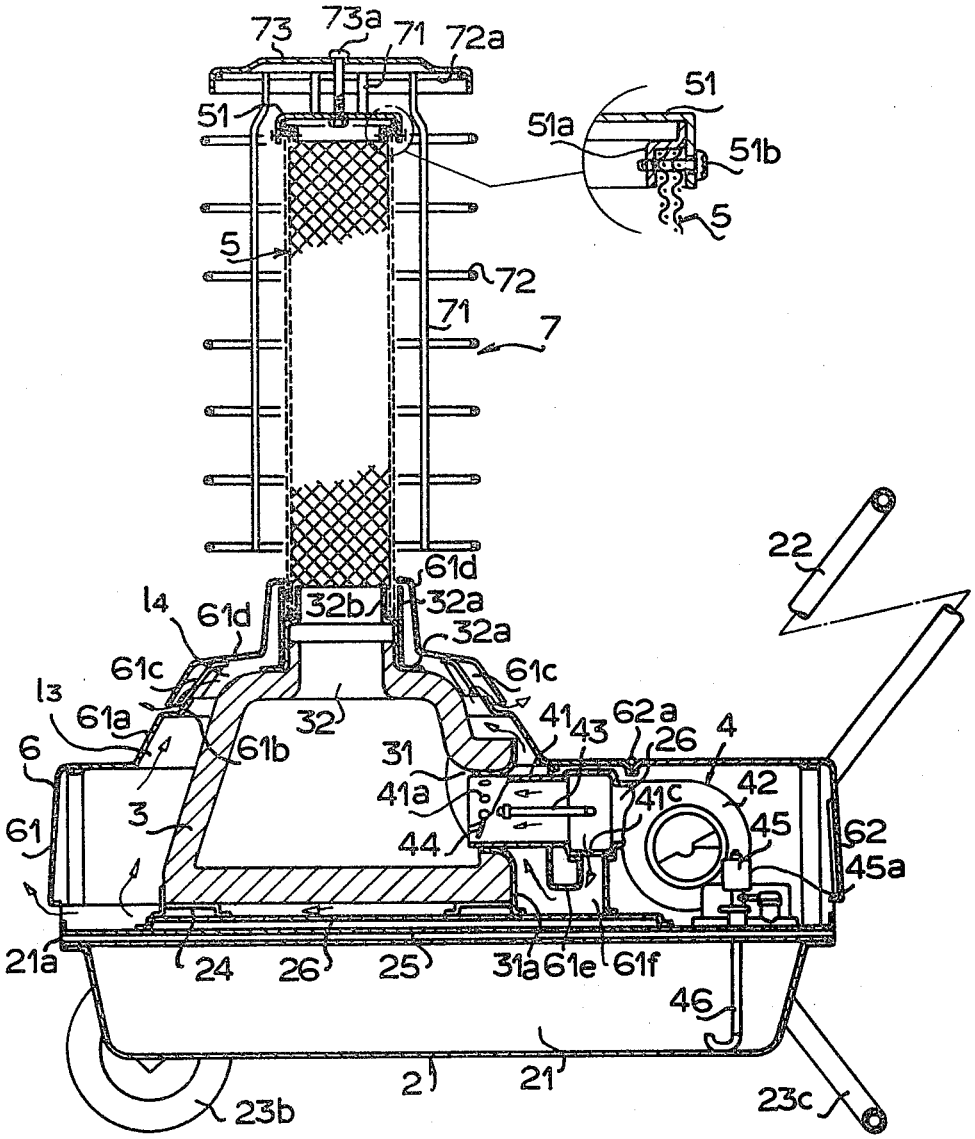
FIG. 2 is its longitudinal sectional view.

Referring to FIGS. 1 and 2, reference numeral 1 designates an oil combustion type infrared ray generating apparatus composed of a flat rectangular fuel tank portion 2 having a flat surface, a frustoconical shaped-hollow furnace body 3, a pressure oil jet type burner 4 including a blower, the furnace body 3 and burner 4 being arranged side by side on the upper surface of the fuel tank portion 2 and communicated with each other, and a red heat cylinder body 5 erected vertically from the upper surface of the furnace body 3 and formed of a wire net cylinder, the red heat cylinder body 5 being communicated with the furnace body 3 via outlet opening 32.

The fuel tank portion 2 is composed of a metal sheet fuel tank 21, a handle 22 secured to the fuel tank 21 by means of screws and a carriage 23. The fuel tank 21 has a volume which can contain 20 l of fuel and is provided at its upper edge with a flange 21*a* extending outwardly along the total periphery of the upper edge. To the lower surface of the flange 21*a* is secured the intermediate portion of the carriage 23 by means of screws. The carriage 23 is composed of a frame 23*a* formed of a bent metal pipe, wheels 23*b*, 23*b* fitted to the front end of the frame 23*a* and a leg 23*c* formed by bending the rear portion of the frame 23*a*. The handle 22 is formed of a pipe which is the same as that of the frame 23*a* and secured to the upper surface side of the flange 21*a* of the fuel tank 21 by means of screws, the rear portion of the handle 22 being bent upwardly.

The furnace body 3 is formed of material which is extremely small in strength, but has an excellent refractory property, for example, ceramic fiber. The furnace body 3 has an internal volume of about 5400 $cm^3$ and a wall thickness of about 3 cm. The furnace body 3 is provided at the rear portion of the side wall thereof with an inlet opening 31 which allows a mixture of the fuel and air to enter thereinto and at the center portion of the upper wall thereof with an outlet opening 32 which allows the combustion gas to discharge therefrom. The inlet inner surface portion of the inlet opening 31 and the outlet inner surface portion of the outlet opening 32 are covered with metal sheets 31*a*, 32*c*, respectively, so as to protect the inlet and outlet inner surface portions of these openings. The furnace body 3 is provided at four outer peripheral portions of the base wall thereof with support metal fittings 24 distant apart from each other. The support metal fittings 24 function to prevent the furnace body 3 from moving in the horizontal direction. In addition, in order to prevent heat from transferring from the base wall of the furnace body 3 to the upper surface side of the fuel tank 21, between the upper surface of the fuel tank 21 and the base wall of the furnace body 3 are interposed heat shielding plates 25, 26 spaced apart from each other in a vertical direction. The end portions of the heat shielding plates 25, 26 are bent toward the upper surface of the fuel tank 21 and firmly secured thereto by welding. To the upper surface of the heat shielding plate 26 are firmaly secured the support metal fittings 24 by welding.

The pressure oil jet burner 4 is provided at the rear end of a fluid supply pipe 41 fitted in the inlet opening 31 of the furnace body 3 with a siroco fan type motor driven blower 42 having a air blowing ability of 24 $m^3$/hour and connected to the rear end of the pipe 41. In the fluid supply pipe 41 are arranged a fuel oil jet pipe 43 extending in the lengthwise direction of the pipe 41 and a stabilizer 44 for diffusing flame in front of the jet pipe 43. The rear portion of the oil jet pipe 43 is bent outwardly in the radial direction from the rear portion of the fluid supply tube 41 and connected to an outlet side of a fuel pump device 45. The outlet side of the fuel pump device 45 is connected to a fuel suction pipe 46 communicated with the fuel tank 21. The fluid supply pipe 41, the inlet opening 31 extended through by the fluid supply pipe 41 and the cover plate 31*a* are connected and arranged as shown in FIG. 3. Let the inner diameter of the inlet opening 31 of the furnace body 3 be 70 mm, the inner diameter of the stainless cover plate 31*a* engaged with the inlet opening 31 be 68 mm and the outer diameter of the fluid supply pipe 41 concentrically inserted into the cylindrical cover plate 31*a* be 67 mm, then a radial (annular) gap l is defined between the cover plate 31*a* and the fluid supply pipe 41. The fluid supply pipe 41 is provided at its circumferential wall with 16 small holes 41*a* each having a diameter of 4 mm and equally distant apart from each other, these small holes 41*a* are located at the intermediate region between the stabilizer 44 and the front end 43*a* of the fuel oil jet pipe 43.

As a result, a part of the compressed air delivered from the blower 42 and flowing through the fluid supply pipe 41 is emitted in the radial direction from the small holes 41*a* to fill up the gap l as shown by an arrow in FIG. 3. Then, the compressed air is flows into the furnace body 3 and also into the outside of the inlet opening 31, thereby maintaining a positive pressure in the gap l by the clean compressed air. As a result, there is no risk of the combustion gas in the furnace body 3 flowing toward the outside through the gap l. Thus, it is possible to prevent leakage of the combustion gas for a long time without inserting a special sealing member between the furnace body 3 near the inlet opening 31 and the fluid supply pipe 41.

The connection means between the inlet opening 31 and the fluid supply pipe 41 constructed as shown in FIG. 4 functions in substantially the same manner as that shown in FIG. 3. In the present embodiment, the fluid supply pipe 41 is inserted into the cover plate 31*a* in the same manner as that shown in FIG. 3. In addition, the front end portion of the fluid supply pipe 41 is made shorter than that of the fluid supply pipe 41 shown in FIG. 3 and an inner tube 41*b* having an outer diameter which is smaller than that of the fluid supply pipe 41, for example, an outer diameter of 66 mm is coaxially inserted into the front end portion of the fluid supply pipe 41 to form an annular gap $l_2$ of 0.5 mm between the front end portion of the fluid supply pipe 41 and the inner tube 41*b*. The inner tube 41*b* is provided at its front end portion with a stabilizer 44. As a result, a portion of the compressed air flowing through the fluid supply pipe 41 flows through the gap $l_2$ toward the inside of the furnace body 3 and this flow of the compressed air portion causes a negative pressure to be produced in a gap l between the cover plate 31*a* and the fluid supply pipe 41, thereby inducing a flow of outside air directed toward the inside of the furnace body through the gap l. As a result, there is no risk of the combustion gas in the furnace body 3 flowing outwardly through in gap l.

Figure 5:
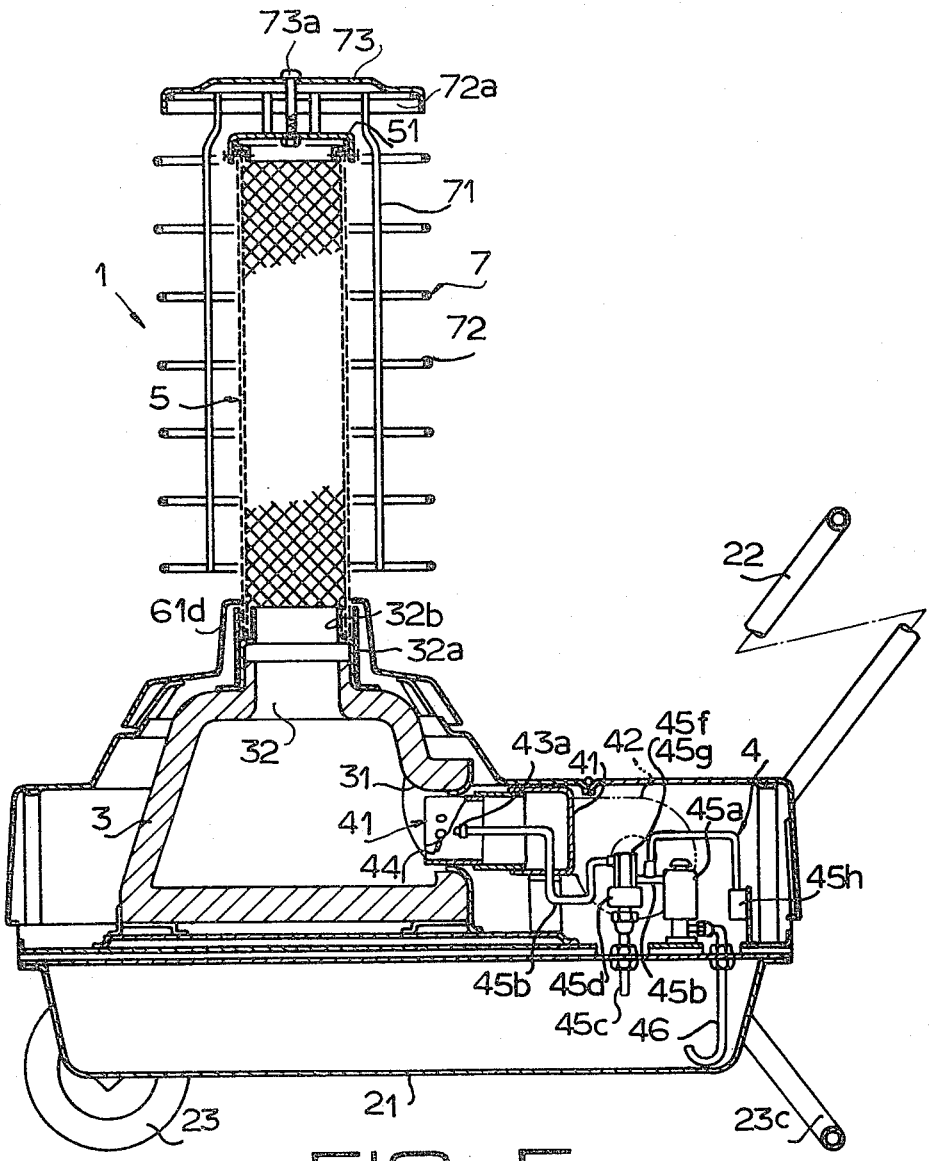
FIG. 5 is a longitudinal sectional view of an apparatus shown in FIG. 1 showing the mode of operating a pump device according to the invention.
Figure 6:
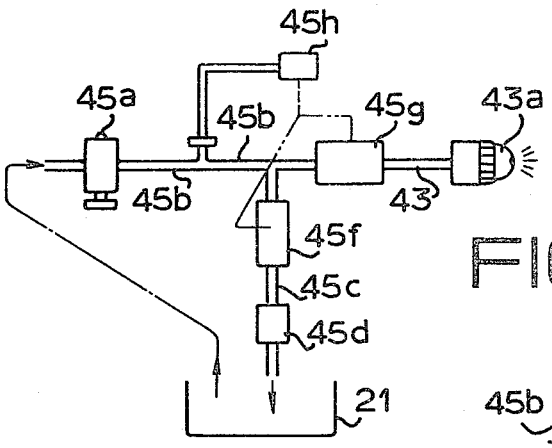
FIG. 6 is a diagrammatic view of one embodiment of a pump device according to the invention.

The fuel pump device 45 of the pressure oil jet burner 4 provided with the blower is constructed as shown in FIGS. 5 and 6.

A fuel suction pipe 46 is extended through the upper wall of the fuel tank 21 and suspended to a position near the base wall thereof. The lower end of the pipe 46 is bent upwardly so as to locate its suction opening at a position which is somewhat higher than the base wall of the fuel tank 21. As a result, it is possible to prevent the pipe 46 from sucking impurities such as water or the like precipitated in the base portion of the fuel tank 21. In addition, in the case of transporting the infrared ray generating apparatus, if the fuel in the fuel tank is inclined to one side of the fuel tank and hence the suction opening of the fuel suction pipe 46 is exposed out of the oil surface, there is no risk of the fuel in the fuel suction pipe 46 being accidentally flowed into the tank 21. The use of the measure of preventing the accidental flow of the fuel in the fuel suction pipe 46 provides the important advantage that the fuel pump 45*a* does not such in air in the case of re-ignition and that combustion can be effected in a rapid manner.

The upper end of the fuel suction pipe 46 is connected to the suction opening side of the fuel pump 45*a* disposed on the upper surface of the fuel tank. The fuel pump 45*a* is composed of an electromagnetic pump including a plunger operative to be reciprocated by the magnetic force and effecting a pump action whose exhaust ability is 1.6 l/hour under a pressure of 7 $kg/cm^2$. To the exhaust side of the fuel pump 45*a* is connected the fuel oil jet pipe 43.

In the present embodiment, provision is made of an air extracting device connected between the exhaust side of the fuel pump 45*a* and the fuel oil jet pipe 43. The air extracting device is composed of a return pipe 45*c* connected to the intermediate part of an oil feed pipe 45*b* interposed between the exhaust side of the fuel pump 45*a* and the fuel oil jet pipe 43 and communicated with the fuel tank 21, an orifice 45*d* connected to the return pipe 45*c* and reducing the passage diameter of the return pipe 45*c*, a first electromagnetic valve 45*f* connected to that portion of the return pipe 45*c* which is directly above the orifice 45*d*, a second electromagnetic valve 45*g* connected to the oil feed pipe 45*b* interposed between the return pipe 45*c* and the fuel oil jet pipe 43, and the pressure switch 45*h* connected to the oil feed pipe 45*b* interposed between the return pipe 45*c* and the fuel pump 45*a* and operative to become ON when the oil pressure in the oil feed pipe 45*b* arrives at about 4 $Kg/cm^2$ and become OFF when the oil pressure in the oil feed pipe 45*b* arrives at a pressure lower than 3 $Kg/cm^2$. The first and second electromagnetic valves 45*f*, 45*g* are set such that when the first electromagnetic valve 45*f* is energized it functions to close the return pipe 45*c* and that when the second electromagnetic valve 45*g* is energized it functions to open the oil feed pipe 45*b*. The first and second electromagnetic valves 45*f*, 45*g* are connected to the pressure switch 45*h*, respectively.

In the initial period of starting the operation of the fuel pump 45*a*, air is introduced into the fuel pump 45*a*. When the fuel pump 45*a* functions to effect its pumping action, the air introduced thereinto becomes expanded and contracted to prevent the normal pumping action of the fuel pump 45*a*. As a result, there is a risk of the exhaust pressure of the fuel pump being lowered. In such a case, the pressure switch 45*h* becomes OFF so as to make the first electromagnetic valve 45*f* open and the second electromagnetic valve 45*g* close. As a result, the mixture of the fuel and air delivered from the fuel pump 45*a* is not fed toward the fuel oil jet pipe 43, but is fed back through the return pipe 45*c* to the fuel tank. Under such condition, the air mixed into the fuel pump 45*a* is gradually decreased and the air mixed into the fuel system inclusive of the fuel suction pipe 46, fuel pump 45*a*, oil feed pipe 45*b* or the like is fed into the oil tank 21. The orifice 45*d* connected to the return pipe 45*c* permits to flow the liquid fuel only therethrough. This viscous resistance causes the pressure in the oil feed pipe 45*b* to raise. If the pressure in the oil feed pipe 45*b* arrives at 4 $kg/cm^2$, the pressure switch 45*h* becomes ON, thereby making the first electromagnetic valve 45*f* close and the second electromagnetic valve 45*g* open. As a result, the fuel containing no air is fed from the fuel pump 45*a* to the fuel oil jet pipe 43 and emitted through the jet nozzle 43*a* fitted to the front end of the pipe 43 into the furnace body 3. In the present embodiment, the time elapsed from the time for starting the operation of the fuel pump 45*a* and removing mixed air from the fuel system to the time at which the fuel is emitted from the jet nozzle 43*a* is about 10 seconds.

Experimental tests have demonstrated the result that of the pressure in the oil feed pipe 45*b* arrives at about 3 $Kg/cm^2$, substantially no mixed air present in the fuel system. But, the pressure required for removing the mixed air from the fuel system is changed in dependence with the rate of viscosity due to the quality of the fuel or the like, so that it is necessary to make its operating pressure of the pressure switch 45*h* correspondent with the pressure required for removing the mixed air from the fuel system.

Figure 7:
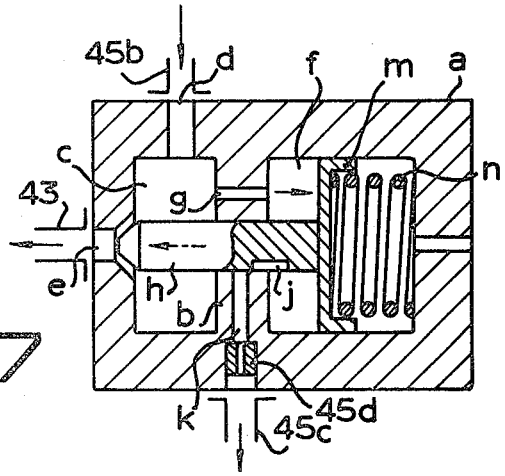
FIG. 7 is an enlarged cross sectional view of another embodiment of a pump device according to the invention.

The above mentioned air extracting device for the fuel pump device 45 may mechanically be constructed as shown in FIG. 7. That is, a valve casing a is divided into front and rear chambers c, f by means of a partition wall b. The front chamber c is provided with an inlet opening d normally communicated with the exhaust side of the fuel pump 45*a* and with an outlet opening e communicated with the side of the jet nozzle 43*a*. The partition wall b is provided with a passage g for communicating the front chamber c with the rear chamber f and slidably supports a plunger h having a small diameter and operative to open and close the outlet opening e. The plunger h is provided at that circumferential portion which is partly engaged with the partition wall b with a notch j normally communicated with the rear chamber f. The partition wall b is provided with a return passage k whose lower end is connected to the return pipe 45*c*. The upper end of the return passage k opens into the bore formed in the partition wall b and engaged with the plunger h. Only when the plunger h is advanced to close the outlet opening e, the upper end of the return passage k is communicated through the notch j with the rear chamber f. To the rear end of the plunger h is secured a large diameter pressure receiving plate m hermetically sealed with the rear chamber f and slidably engaged therewith. The pressure receiving plate m is always urged forwardly by the reaction force of a spring n. The return passage k is provided at its lower end portion with an orifice 45*d*.

The air extracting device constructed as above described is capable of feeding back the fuel delivered from the fuel pump 45*a* through the inlet opening d, passage g, notch j, passage k and return pipe 45*c* to the fuel tank 21 at the beginning at which the delivering pressure of the fuel is low. Under such condition, if air mixed into the fuel system is removed, the fluid resistance in the orifice 45*d* becomes high to increase the pressure in the front and rear chambers c, f. The pressure in the rear chamber f acts upon the pressure receiving plate m to move it rearwardly against the reaction force of the spring n.

At the same time, the plunger h is rearwardly moved to open the outlet opening e and close the return passage k.

As a result, the fuel delivered from the fuel pump 45*a* into the front chamber c is flowed through the outlet opening e into the fuel oil jet pipe 43 and then supplied from the jet nozzle 43*a* into the furnace body 3.

The red heat cylindrical body 5 will now be described. The red heat cylindrical body 5 is composed of a cylindrical wire net formed of iron chrome electric heating wires. The wire has a diameter of 0.18 mm and the wire net has a size of 60 meshes and is woven by plain weave. The red heat cylindrical body 5 is composed of outer and inner cylindrical bodies. The inner cylindrical body has an inner diameter of 95.8 mm and the outer cylindrical body has an inner diameter of 99 mm. The inner and outer cylindrical bodies have a longitudinal length of 358 mm. If the red heat cylindrical body 5 is composed of inner and outer cylindrical bodies and formed of wire net having 60 meshes, the inside of the red heat cylindrical body 5 becomes opaque from the outside. As a result, it is possible to prevent the combustion flame in the furnace body 3 from being seen from the outside and hence eliminate the user's uneasiness. In addition, the red heat cylindrical body 5 as a whole is uniformly red heated. Moreover, if the red heat cylindrical body is formed of the above mentioned material, the red heat cylindrical body is less deteriorated due to oxidation and hence has an excellent durability.

Figure 8:
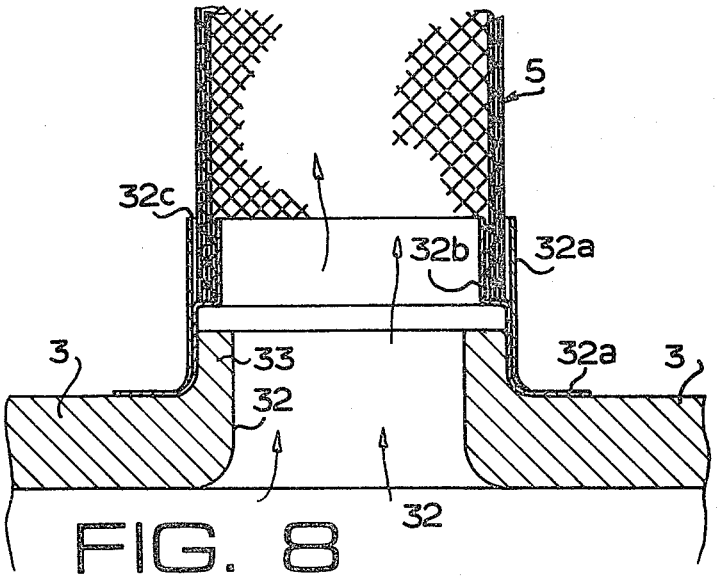
FIG. 8 is an enlarged cross sectional view of one embodiment of an outlet opening portion of a furnace body according to the invention.

The red heat cylindrical body 5 is connected to the furnace body 3 as shown in FIG. 8. The outlet opening 32 of the furnace body 3 has an inner diameter of 70 mm and a flanged portion 33 of the outlet opening 32 has an outer diameter of 100 mm. To the outer periphery of the flanged portion 33 is secured the cover plate 32*a* and a stepped inner tube 32*b* is secured by welding to the inner periphery of the upper portion of the cover plate 32*a*. The stepped inner tube 32*b* is composed of an upwardly facing reduced diameter portion and a downwardly facing large diameter portion. Between the upper portion of the cover plate 32*a* and the upper portion of the stepped inner tube 32*b* there is defined an upwardly facing annular groove 32*c* into which is inserted the lower portion of the red heat cylindrical body 5. The reduced diameter portion of the stepped inner tube 32*b* has an inner diameter of 90 mm which is larger than the inner diameter of 70 mm of the outlet opening 32. As a result, the flow of the combustion gas delivered from the outlet opening 32 induces a negative pressure at the outer periphery of the upper end of the outlet opening 32 such that the outside air flows into the inside of the red heat cylindrical body 5 through a gap formed at the separated junction between the flanged portion 33 of the furnace body 3 and the cover plate 32*a*. Thus, there is no risk of the high temperature gas leaking onwardly through the gap formed at the above mentioned separated junction.

The furnace body 3 and pressure oil jet burner 4 provided with the blower are surrounded by a sheet metal cover 6 having a lower portion secured to the upper portion of the fuel tank 21. As shown in FIG. 2, the cover 6 is composed of a front cover 61 for covering the furnace body 3 and fluid supply pipe 41 and a rear cover 62 for covering the blower 42 and fuel pump device 45. The upper portion 61*a* of the front cover 61 is bulged upwardly and extended along the peripheral wall of the furnace body 3 with a gap $l_3$ formed therebetween. The top portion of the front cover 61 is made widely open so as to expose the upper wall of the furnace body 3. The upper portion of the bulged portion 61*a* is reduced in diameter so as to form a step-shaped reduced diameter portion 61*b*. To the other periphery of the reduced diameter portion 61*b* is secured through a stay 61*c* a chrome plated ornamental cover 61*d*.

The ornamental cover 61*d* is extended along the outer periphery of the reduced diameter portion 61*b*, upper portion of the furnace body 3 and upper portion of the cover plate 32*a* and covers these elements with a gap $l_4$ formed therebetween.

The rear surface of the front cover 61 is partly closed at the lower part of the fluid supply pipe 41 to define an air passage 61*f* through which flows a portion of the compressed air flowing the fluid supply pipe 41 from an air outlet opening 41*c* forward at the lower rear wall of the fluid supply pipe 41. This portion of the compressed air flows from the air passage 61*f* along the outer peripheral surface of the furnace body so as to cool it and then flows through the lower portion of the front cover 61, the gap formed between the front cover 61 and the ornamental cover 61*d*, the gap formed between the ornamental cover 61*d* and the cover plate 32*a* or the like and finally is delivered to the outside of the apparatus.

Figure 2A:
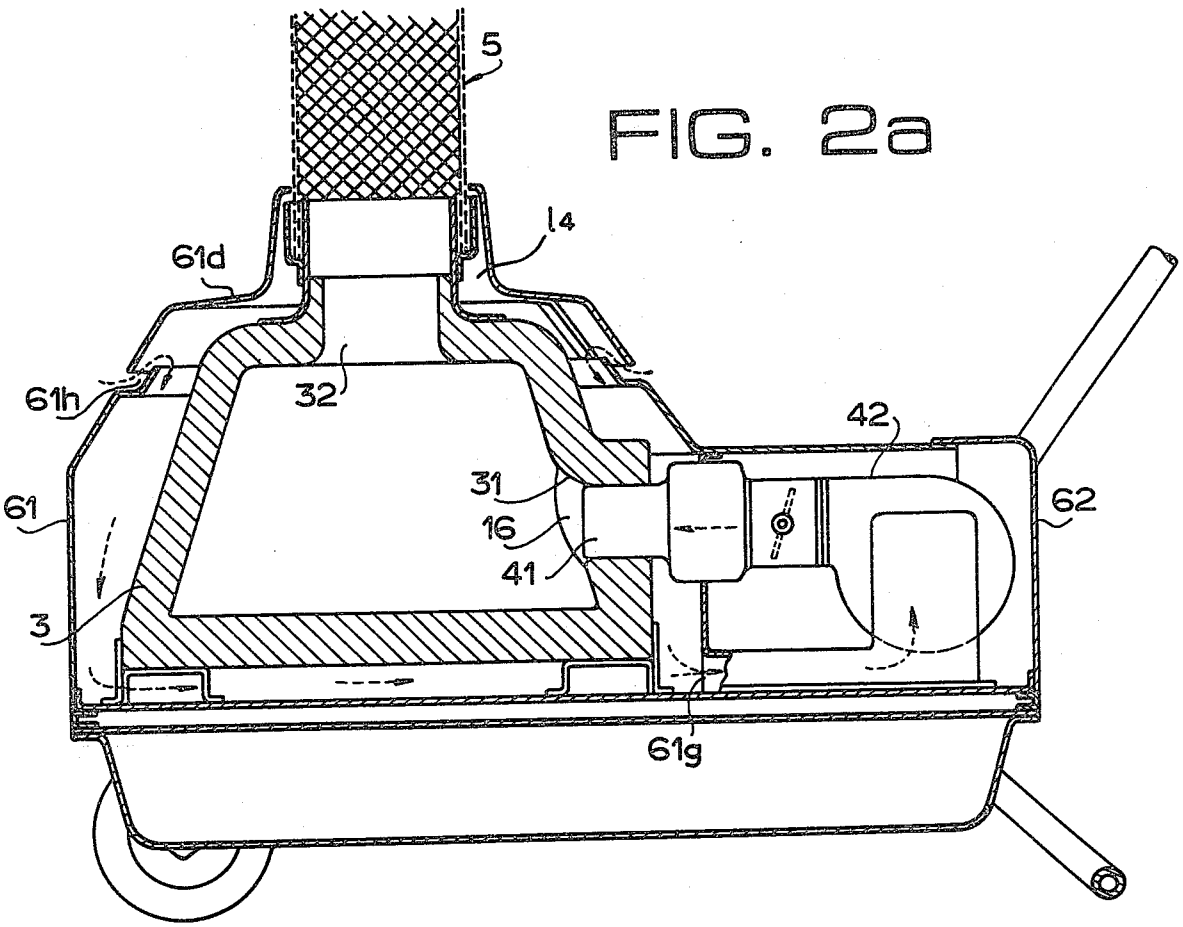
FIG. 2*a* is a sectional view showing another example of furnace body cooling means.

FIG. 2*a* shows another example of furnace body cooling means. In the apparatus, an intake opening 61*g* of the blower 42 is communicated with the space between the furnace body 3 and the front cover 61. Thus, the air induced from the gap 61*h* by the blower 42 flows passing through the space between the furnace body 3 and the front cover. Accordingly, the furnace body 3 may be cooled by the suction air.

To the upper peripheral wall of the ornamental cover 61*d* are secured through a metal fitting 71*a* supporting poles 71 extending vertically and supporting a chrome plated metal protector 7 as shown in FIG. 1. As shown in FIG. 2, the rear cover 62 of the cover 6 is mounted on the rear edge of the front cover 61 through a hinge 62*a* so that the rear cover 62 can be rotated about the hinge 62*a*. As a result, it is possible to maintain and inspect the fuel pump 45, blower 42 or the like in an easy manner.

As shown in FIGS. 1 and 2, the protector 7 is composed of four supporting poles 71 two of which are secured to opposite sides of the ornamental cover 61*d*, respectively, and extended vertically, and a guard 72 consisting of eight annular bodies equally distant apart from each other in the vertical direction and secured to the supporting poles 71 by welding. The guard 72 includes a top guard 72*a* having a diameter somewhat smaller than those of the other guards and a top cover 73 covering the top guard 72*a* and secured thereto. The top cover 73 is provided at its center portion with a bolt 73*a* hanging downwardly. To the lower end of the bolt 73*a* is secured a cover 51 hanging downwardly and closing the upper open portion of the red heat cylindrical body 5. The cover 51 engages with the outer periphery of the upper end of the red heat cylindrical body 5 so as to firmly clamp it between the cover 51 and a metal fitting 51*a* by means of a bolt 51*b*.

Figure 9:
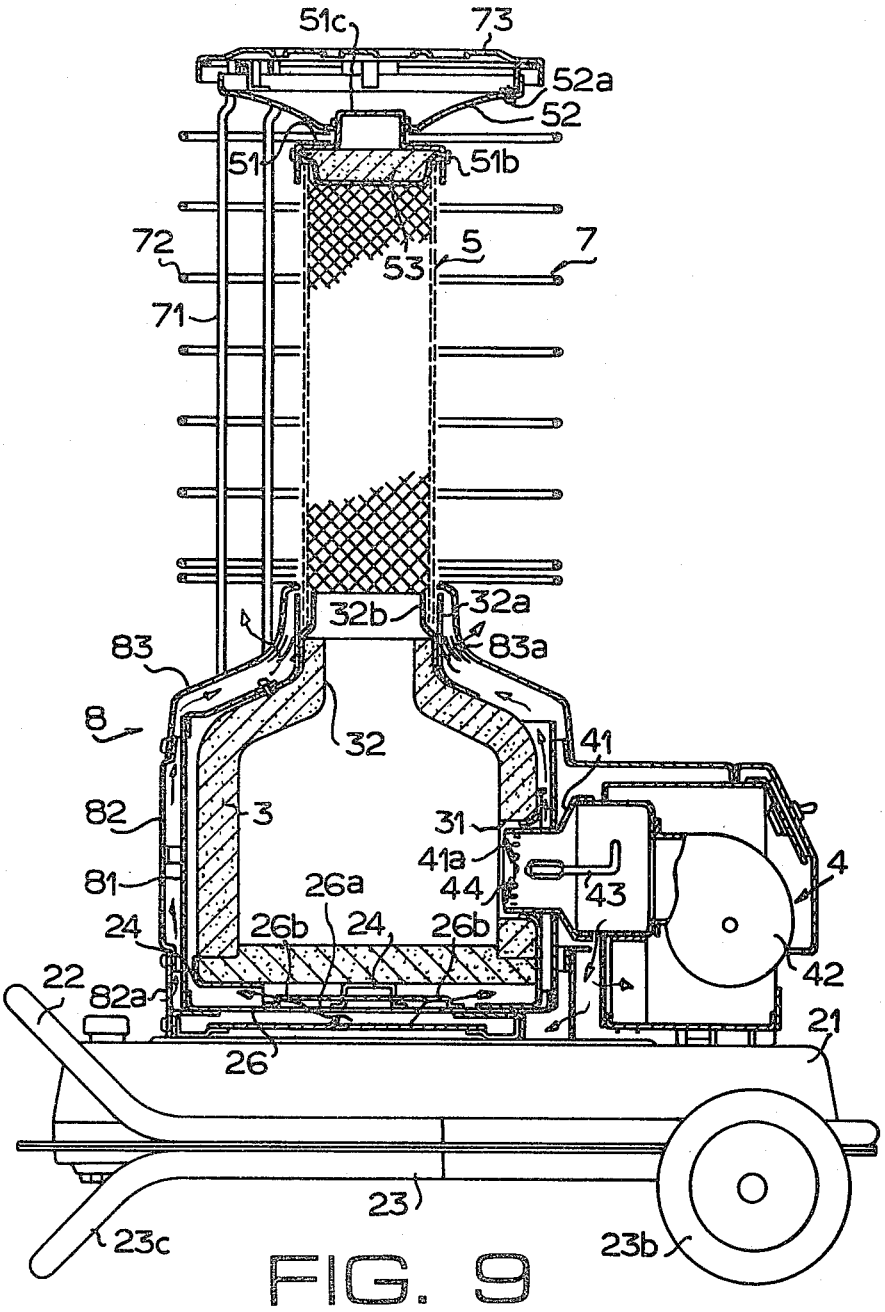
FIG. 9 is a longitudinal sectional view of another embodiment of an oil combustion type infrared ray generating apparatus according to the invention.

FIG. 9 shows a preferred embodiment of an oil combustion type infrared ray gnerating apparatus according to the invention, which is improved in design and low in manufacturing cost, the essential parts being shown in section. A furnace body 3 shown in FIG. 9 is composed of a barrel consisting of a cylindrical body and having an inner diameter of 200 mm and a cover 8 for covering the furnace body 3.

The cover 8 is of substantially inner and outer walled construction. An inner cover 81 surrounds the barrel of the furnace body 3 with a substantially uniform gap formed therebetween and an outer cover 82 surrounds the inner cover 81 with a gap formed therebetween and communicated with the pressure oil jet burner with the blower 4. To the upper portion of the outer cover 82 is secured an ornamental cover 83. The ornamental cover 83 is of substantially conical shaped one and surrounds the upper portion of the furnace body 3 and a cover plate 32*a* with a substantially uniform gap formed therebetween. The outer cover 82 is provided at its lower end portion with a number of air flow holes 82*a* arranged along the total periphery thereof. The ornamental cover 83 is provided at its upper end portion with a number of air flow holes 83*a* arranged along the total periphery thereof.

The use of such measure provides the important advantage that when the flow of air in the cover 8 is heated by the furnace body 3 the outside air flows through the air flow holes 82*a* provided at the lower end portion of the outer cover 82 into the cover 8 and heat exchanger is effected with the furnace body 3 and then flows out of the air flow holes 83*a* provided at the upper end portion of the ornamental cover 83, that is, natural convection current is induced, and that there is no need of providing a special forced cooling means.

The furnace body 3 is provided at its base portion with two heat shielding plates 25, 26. The upper side heat shielding plate 26 is provided at that portion thereof corresponding to the center portion of the base wall of the furnace body 3 with a large diameter 26*a* which is covered with a perforated plate 26*b* secured to the heat shielding plate 26 by welding. As a result, the greater part of the radiation heat leaked out of the base wall of the furnace body 3 is shielded by the perforated plate 26*b*. The outside air entered through the lower part of the cover 8 heat exchanges with the perforated plate 26*b* and base wall of the furnace body 3 and is flowed toward the outer periphery and then flows upwardly and finally flowed through the air flow holes 83*a* to the outside, thereby inducing the natural convection current.

The cover 51 for closing the upper portion of the red heat cylindrical body 5 is provided at its center portion with an upwardly bulged portion 51*c* with which is engaged an inverted conical reflecting plate 51. The upper peripheral edge of the reflecting plate 51 engages with the inner periphery of the lower surface of the top cover 73 and is secured to the latter by means of screws 52*a*. In addition, in the cover 51 for closing the top portion of the red heat cylindrical body 5 is enclosed a heat insulating body 53 formed of a refractory and heat insulating material such as ceramic fiber or the like.

The use of the cover 51 constructed as above described ensures a decrease of deterioration of various members located above the red heat cylindrical body 5 and subjected to heat and provides the important advantage that the upward radiation of heat is decreased so as to improve the radiation efficiency of heat toward the side surroundings.

The apparatus constructed as above described according to the invention is capable of mounting the furnace body 3, pressure oil jet burner with blower 4 and red heat cylindrical body 5 or the like as a whole on the flat upper surface of the fuel tank 21 and hence of making the apparatus as a whole small in size. In addition, the apparatus is located in the projected plane region of the fuel tank 21, so that the highly rigid peripheral wall of the fuel tank 21 functions to prevent the apparatus from being injured by the obstacles. In addition, in the case of moving the apparatus to a given working site, the handle 22 can be raised to separate the leg 23*c* from the ground surface, and as a result, it is possible to move the apparatus while rotating the wheels 23*b*, thereby moving the apparatus in a safe manner.

The operation of the apparatus according to the invention will now be described. In the first place, the pressure oil jet burner with the blower 4 is started into operation. That is, the blower 42 is driven to supply the combustible gas through the fluid supply pipe 41 and inlet opening 31 to the furnace body 3. At the same time, the fuel pump 45*a* is driven to suck the fuel in the fuel tank 2 into the fuel suction pipe 46. Then, the fuel is supplied through the oil feed pipe 45*b* and fuel oil jet pipe 43 to the jet nozzle 43*a*. The jet nozzle 43*a* functions to atomize the fuel and emit the atomized fuel into the furnace body 3. The emitted fuel is ignited by spark discharge electrodes (not shown) fitted in a position directly behind the jet nozzle 43*a* and subjected to complete combustion in the furnace body 3 by the combustible air.

The combustion gas in the furnace body 3 is flow through the outlet opening 32 into the red heat cylindrical body 5 and then flow through each mesh of the overall surface of the red heat cylindrical body 5 to the outside. The gas passing through each mesh transfers its heat by heat exchange of the high temperature gas which has been subjected to combustion, thereby uniformly red heating the overall surface of the red heat cylindrical body 5. As a result, infrared rays are emitted from the apparatus toward the surroundings. In this case, the red heat cylindrical body 5 is cylindrical in shape, so that the infrared rays are uniformly emitted in the horizontal direction toward the surroundings.

As above described, between the fuel pump 45*a* and the fuel oil jet pipe 43 is interposed the air extracting device, and as a result, when the fuel is emitted from the jet nozzle 43*a*, the fuel oil jet pipe 43 is kept under a high pressure from the initial time and the fuel emitted from the jet nozzle 43*a* is always kept under a good atomized condition and supplied into the furnace body 3. Thus, the fuel is always subjected to complete combustion in the furnace body 3 and it is possible to prevent the red heat cylindrical body 5 from being clogged due to incomplete combustion for emitting smoke or the like and uniformly red heat the overall surface of the red heat by cylindrical body 5.

In addition, a part of the compressed air delivered from the blower 42 or suction air is caused to be flow through the space between the furnace body 3 and the cover 6 so as to discharge the heat leaking from the surroundings of the furnace body 3 to the outside. As a result, the fuel tank 21 and the burner 4 or the like can be arranged near by at hand without heating them, thereby making the apparatus small in size and safe in operation.

Moreover, the fluid supply pipe 41 is freely engaged with the inlet opening 31 with the gap formed therebetween in the radial direction and a part of the compressed air delivered from the blower is caused to pass through this gap, and as a result, it is possible to prevent the combustion gas in the furnace body 3 from flowing out of it, whereby the apparatus is easy in assembling, less expensive and can improve workability.

Finally in the case of connecting the red heat cylindrical body 5 to the outlet opening 32, the diameter of the outlet opening 32 is made smaller than the inner diameter of the red heat cylindrical body 5. As a result, a negative pressure is produced at the junction portion between these two members when the combustion gas flows out through the outlet opening 32. Thus it is possible to prevent the combustion gas from flowing out through the junction in a useless manner, thereby preventing the cover 6 from being abnormally heated.

As stated hereinbefore, the apparatus according to the invention can be used for heating rooms and drying painted surfaces at indoor and outdoor sites where the temperature of surround air is frequently changed without trouble in working and in a safe manner.

What is claimed is:

1. An oil combustion type infrared ray generating apparatus comprising a fuel tank composed of a vessel having a flat upper surface, a frustoconical-shaped furnace body having an excellent heat insulating and refractory property and provided at its upper wall with an outlet opening and at its side wall with an inlet opening, a pressure oil jet burner provided with a blower and connected to said inlet opening in the side wall of said furnace body, said furnace body and pressure oil jet burner with said blower being mounted side by side on said flat upper surface of said fuel tank, a red heat cylindrical body erected vertically from an upper part of said furnace body and formed of refractory material, said red heat cylindrical body being permeable to gas and connected to said outlet opening in the upper wall of said furnace body, said furnace body being formed of material which is low in strength and easily deformable under load, but with said excellent refractory and heat reflecting property and includes a fluid supply pipe of said burner being freely inserted into said inlet opening in the side wall of said furnace body with a radial gap formed adjacent and therebetween so as to connect said burner to said furnace body, means for causing a part of flow of compressed air delivered from the blower of said burner to flow through said gap, and said outlet opening in the upper wall of said furnace body having a diameter which is smaller than the inner diameter of said red heat cylindrical body such that combustion gas flowing out of the furnace body through said outlet opening produces a negative pressure around the periphery of said outlet opening preventing leakage between the furnace body and the red-heat cylinder.

2. The apparatus according to claim 1, wherein said furnace body is covered with an incombustible cover with a gap formed therebetween and a part of the flow of compressed air delivered from the blower of the pressure oil jet burner is flowed through said gap so as to cool the surrounding of the furnace body.

3. The apparatus according to claim 1, wherein said furnace body is covered with an incombustible cover with a gap formed therebetween and a part of the flow of suction air flows through said gap so as to cool the surrounding of the furnace body.

4. The apparatus according to claim 1, wherein said furnace body is covered with a cover which is high in rigidity and strength and to said cover are secured vertically erecting supporting poles, the upper part of said red heat cylindrical body being engaged with and supported by said supporting poles.

5. The apparatus according to claim 1, wherein said red heat cylindrical body is composed of at least two concentrically arranged walls each formed of metal net having 45 meshes to 70 meshes.

6. The apparatus according to claim 1, wherein said fuel tank is provided with wheels and a handle.

7. The apparatus according to claim 1, wherein said means constitutes a plurality of openings formed in said fluid supply pipe adjacent said gap maintaining a positive pressure in said gap by said part of said flow of compressed air delivered from the blower.

8. The apparatus according to claim 1, wherein said means constitutes an inner tube spaced from and overlapping an end of said fluid supply pipe and spaced from said inlet opening forming a pair of said gap therebetween and forming a second gap between said inner tube and said fluid supply pipe through which said part of said flow of compressed air delivered from the blower passes producing a negative pressure in said first-mentioned gap inducing a flow of outside air to enter said furnace body through said first-mentioned gap.

9. The apparatus according to claim 7 or 8, further comprising a fuel jet pipe centrally disposed in said fluid supply tube, and a stabilizer positioned in front of a discharge end of said jet pipe adjacent said means.

10. The apparatus according to claim 1, wherein said upper wall of said furnace body is formed with an upwardly extending flange, an inwardly stepped inner tube is mounted on said flange and defines an upper portion of said outlet opening, the latter being partially formed in said flange and in said stepped tube, a cover plate is mounted to and around said inner tube forming an upwardly facing annular groove in which a lower portion of said red heat cylindrical body is inserted.

11. An oil combustion type infrared ray generating apparatus comprising a fuel tank composed of a vessel having a flat upper surface, a frustoconical-shaped furnace body having an excellent heat insulating and refractory property and provided at its upper wall with an outlet opening and at its side wall with an inlet opening, a pressure oil jet burner provided with a blower and connected to said inlet opening in the side wall of said furnace body, said furnace body and pressure oil jet burner with said blower being mounted side by side on said flat upper surface of said fuel tank, a red heat cylindrical body erected vertically from an upper part of said furnace body and formed of refractory material, said red heat cylindrical body being permeable to gas and connected to said outlet opening in the upper wall of said furnace body, said furnace body is covered with an incombustible cover with a gap formed therebetween and a part of the flow of compressed air delivered from the blower of the pressure oil jet burner flows through said gap so as to cool the surrounding of the furnace body, and said cover is high in rigidity and strength and vertically erect supporting poles are secured to said cover, an upper part of the red heat cylindrical body being engaged with and supported by said supporting poles.

* * * * *